US006552495B1

(12) United States Patent
Chang

(10) Patent No.: US 6,552,495 B1
(45) Date of Patent: Apr. 22, 2003

(54) ADAPTIVE CONTROL SYSTEM AND METHOD WITH SPATIAL UNIFORM COLOR METRIC FOR RGB LED BASED WHITE LIGHT ILLUMINATION

(75) Inventor: Chin Chang, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/024,737

(22) Filed: Dec. 19, 2001

(51) Int. Cl.[7] ..... H05B 37/00
(52) U.S. Cl. ..... 315/169.3; 315/158; 315/159
(58) Field of Search ..... 315/169.3, 309, 315/158, 159

(56) References Cited

U.S. PATENT DOCUMENTS 6,411,046 B1 * 6/2002 Muthu ..... 315/309

* cited by examiner

*Primary Examiner*—David Vu

(57) ABSTRACT

The present invention is directed to a control system for generating a desired light color by a plurality of Red, Green and Blue light emitting diodes (LEDs) comprised of a sensor responsive to a light color generated by the plurality of LEDs to measure the color coordinates of the generated light where the color coordinates are defined in a first color space. A first transformation module is provided, coupled to the sensor to transform the coordinates of the generated light to a second color space. A second transformation module is configured to provide reference color coordinates corresponding to the desired light, where the reference color coordinates are expressed in the second color space. An adder is provided, coupled to the transformation module and the reference module configured to generate an error color coordinate corresponding to a difference between the desired light color coordinates and the generated light color coordinates. A driver module is coupled to the adder and configured to generate a drive signal for driving the LEDs.

14 Claims, 6 Drawing Sheets

ADAPTIVE CONTROL SYSTEM AND METHOD WITH SPATIAL UNIFORM COLOR METRIC FOR RGB LED BASED WHITE LIGHT ILLUMINATION

RELATED APPLICATIONS

This application is related to a copending patent application Ser. No. 10/024,738 entitled AN RGB LED BASED WHITE LIGHT CONTROL SYSTEM WITH QUASI-UNIFORM COLOR METRIC, filed concurrently with the present application and assigned to the same assignee.

FIELD OF THE INVENTION

This invention relates to a color mixing system and method and more specifically to an RGB, light emitting diode controller for providing desired colors.

BACKGROUND OF THE INVENTION

Conventional color control systems employ a feedback control arrangement to maintain a desired color emitted by for example an RGB, LED light source. However, it is known that visual sensitivity to small color differences is one of the considerations when determining the precision of a color control system.

Traditionally, in order to control and maintain a desired light color and intensity, a color space diagram is employed and various primary color light sources, such as Red, Green and Blue are controlled in accordance with the values represented by the color space diagram.

An exemplary color space is the RGB space, which is represented by a three-dimensional space whose components are the red, green, and blue intensities, along with their spectrum that make up a given color. For example, scanners read the amounts of red, green, and blue light that are reflected from an image and then convert those amounts into digital values. Displays receive the digital values and convert them into red, green, and blue light seen onscreen. RGB-based color spaces are the most commonly used color spaces in computer graphics, primarily because they are supported by many color displays and scanners. However, a shortcoming with using an RGB color space is that it is device dependent and additive.

Some color spaces can express color in a device-independent way. Whereas RGB colors vary with display and scanner characteristics, device-independent colors are meant to be true representations of colors as perceived by the human eye. These color representations, called device-independent color spaces, result from work carried out in 1931 by the Commission Internationale d'Eclairage (CIE) and for that reason they are also called CIE-based color spaces.

The CIE created a set of color spaces that specify color in terms of human perception. It then developed algorithms to derive three imaginary primary constituents of color—X, Y, and Z—that can be combined at different levels to produce all the color the human eye can perceive. The resulting color model, CIE, and other CIE color models form the basis for all color management systems. Although the RGB and CMYK values differ from device to device, human perception of color remains consistent across devices. Colors can be specified in the CIE-based color spaces in a way that is independent of the characteristics of any particular display or reproduction device. The goal of this standard is for a given CIE-based color specification to produce consistent results on different devices, up to the limitations of each device.

There are several CIE-based color spaces, such as xyL, uvL, u*v*L, a*b*l, etc., but all are derived from the fundamental XYZ space. The XYZ space allows colors to be expressed as a mixture of three tristimulus values X, Y, and Z. The term tristimulus comes from the fact that color perception results from the retina of the eye responding to three types of stimuli. After experimentation, the CIE set up a hypothetical set of primaries, XYZ, that correspond to the way the eye's retina behaves.

The CIE defined the primaries so that all visible light maps into a positive mixture of X, Y, and Z, and so that Y correlates approximately to the apparent lightness of a color. Generally, the mixtures of X, Y, and Z components used to describe a color are expressed as percentages ranging from 0 percent up to, in some cases, just over 100 percent. Other device-independent color spaces based on XYZ space are used primarily to relate some particular aspect of color or some perceptual color difference to XYZ values.

FIG. 1 is a plot of a chromaticity diagram as defined by CIE (Commission Internationale de l'Eclairage). Basically, the CIE chromaticity diagram of FIG. 1 illustrates information relating to a standard set of reference color stimuli, and a standard set of tristimulus values for them. Typically, the reference color stimuli are radiations of wavelength 700 nm for the red stimulus (R), 546.1 nm for the green stimulus (G) and 435.8 nm for the blue stimulus (B). Different color points along curve 60 can be combined to generate a white light depicted at point 62. The chromaticity diagram shows only the proportions of tristimulus values; hence bright and dim colors having the same proportions belong to the same point.

As mentioned before, one drawback of the XYZ space as employed for controlling an RGB light source is that in a system that is configured to control a desired color point, for example, $X_w$, $Y_w$, $Z_w$, a deviation from this desired color point may have a different visual impact, depending on the direction of the deviation. That is the perceptual color difference for the same amount of error in the color point location, would be different depending on where the color point with error is located, on the chromaticity diagram, in relation to the desired color point location.

Therefore, even if a system is employed with a very small error control scheme, the perceptual color difference may be still large for certain errors and excessively small for other color point errors. As such, the feedback system either over compensates or under compensates color point errors.

Thus, there is a need for an RGB LED controller system that employs a feedback control arrangement that substantially corrects all color point errors without visual perception of change in color.

BRIEF SUMMARY OF THE INVENTION

In accordance with one embodiment of the invention, a control system for generating a desired light by a plurality of Red, Green and Blue light emitting diodes (LEDs) comprises a sensor responsive to a light generated by the LEDs to measure the color coordinates of the generated light, wherein the color coordinates are defined in an X, Y, Z color space. A transformation module is coupled to the sensor to transform the coordinates of the generated light to a second color space, such as an x', y' color space, in accordance with a Farnsworth transformation. A reference module is configured to provide reference color coordinates corresponding to the desired light, wherein the reference color coordinates are expressed in the second color space. An error module is coupled to the transformation module and the reference module and is configured to generate an error color coordinate corresponding to a difference between the desired white light color coordinates and the generated white light color coordinates. A driver module is coupled to the error module and is configured to generate a drive signal for driving the LEDs.

DETAILED DESCRIPTION OF THE DRAWINGS

Figure 1:
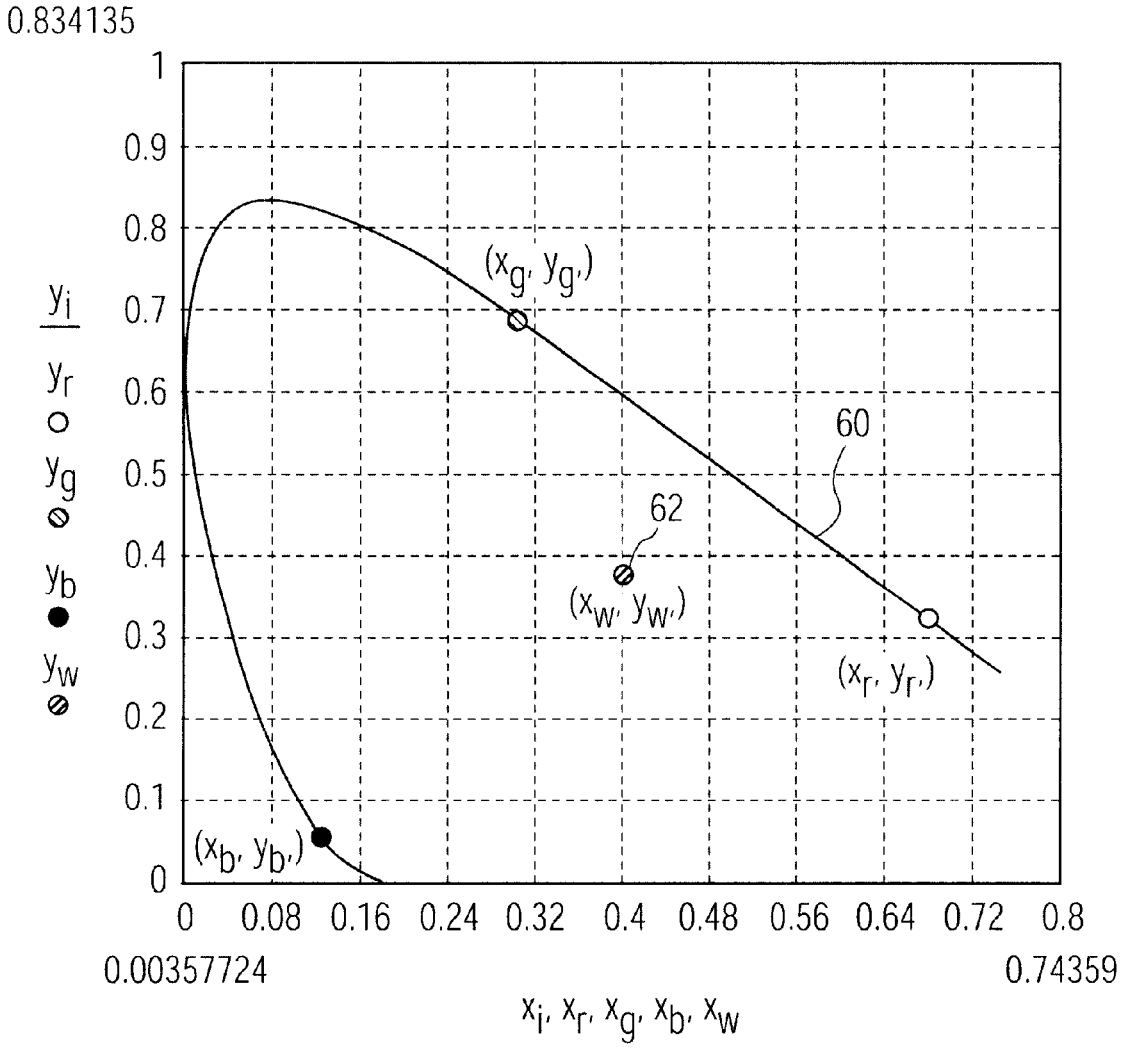
FIG. 1 illustrates a color space diagram in accordance with one embodiment of the invention.
Figure 2:
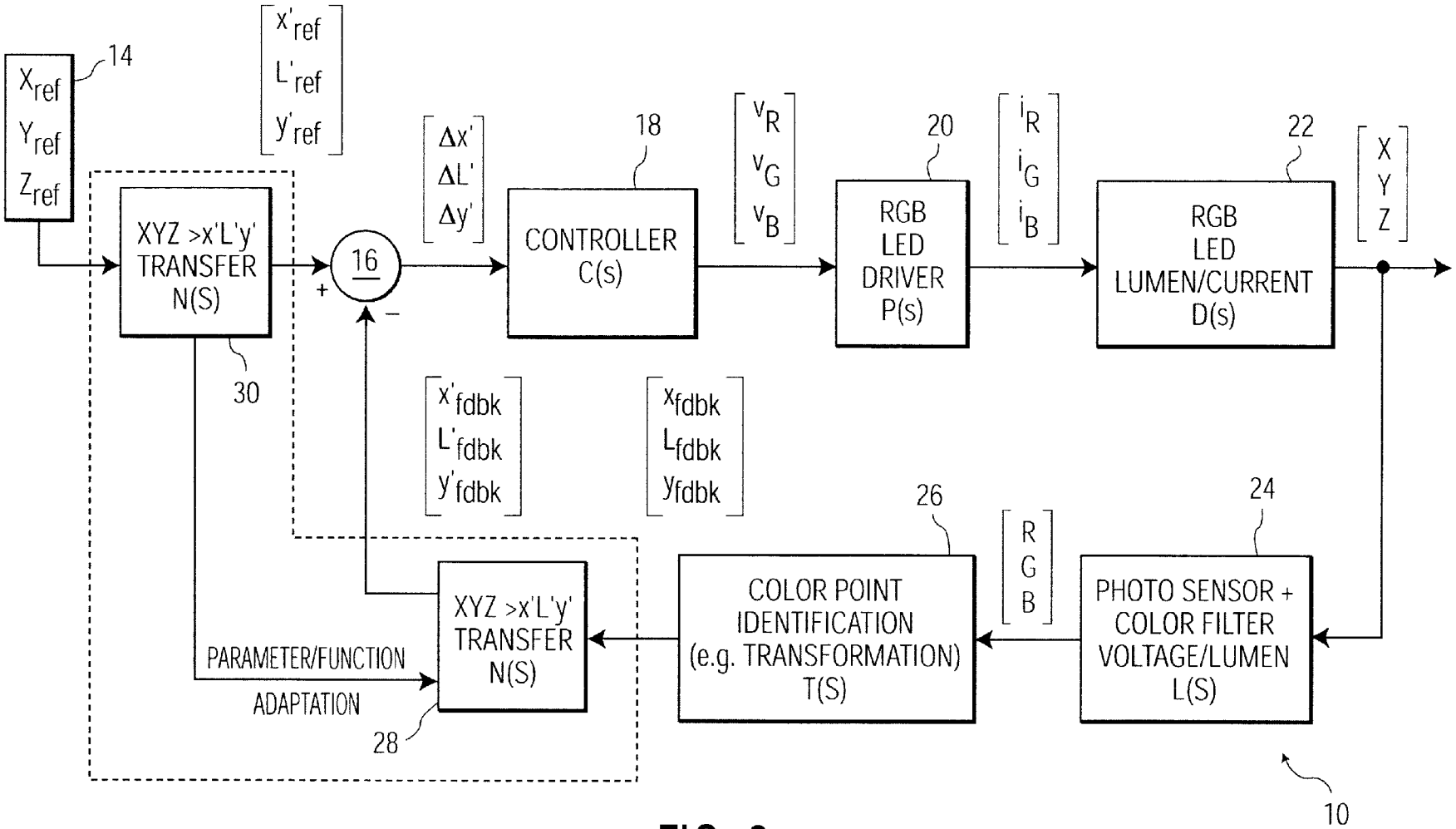
FIG. 2 is block diagram of a control system in accordance with one embodiment of the invention.

FIG. 2 illustrates a control system 10 for controlling light generated by an RGB, LED luminary module 22in accordance with one embodiment of the invention. More specifically, in accordance with a preferred embodiment of the invention, control system 10 is employed to control the LEDs to generate a desired color light, having reference colorometry coordinate values $X_{ref}$, $Y_{ref}$ and $Z_{ref}$.

FIG. 2 includes a buffer 14 that is configured to store the desired colorometry coordinate values of a desired light in X, Y, Z format.

Figure 5:
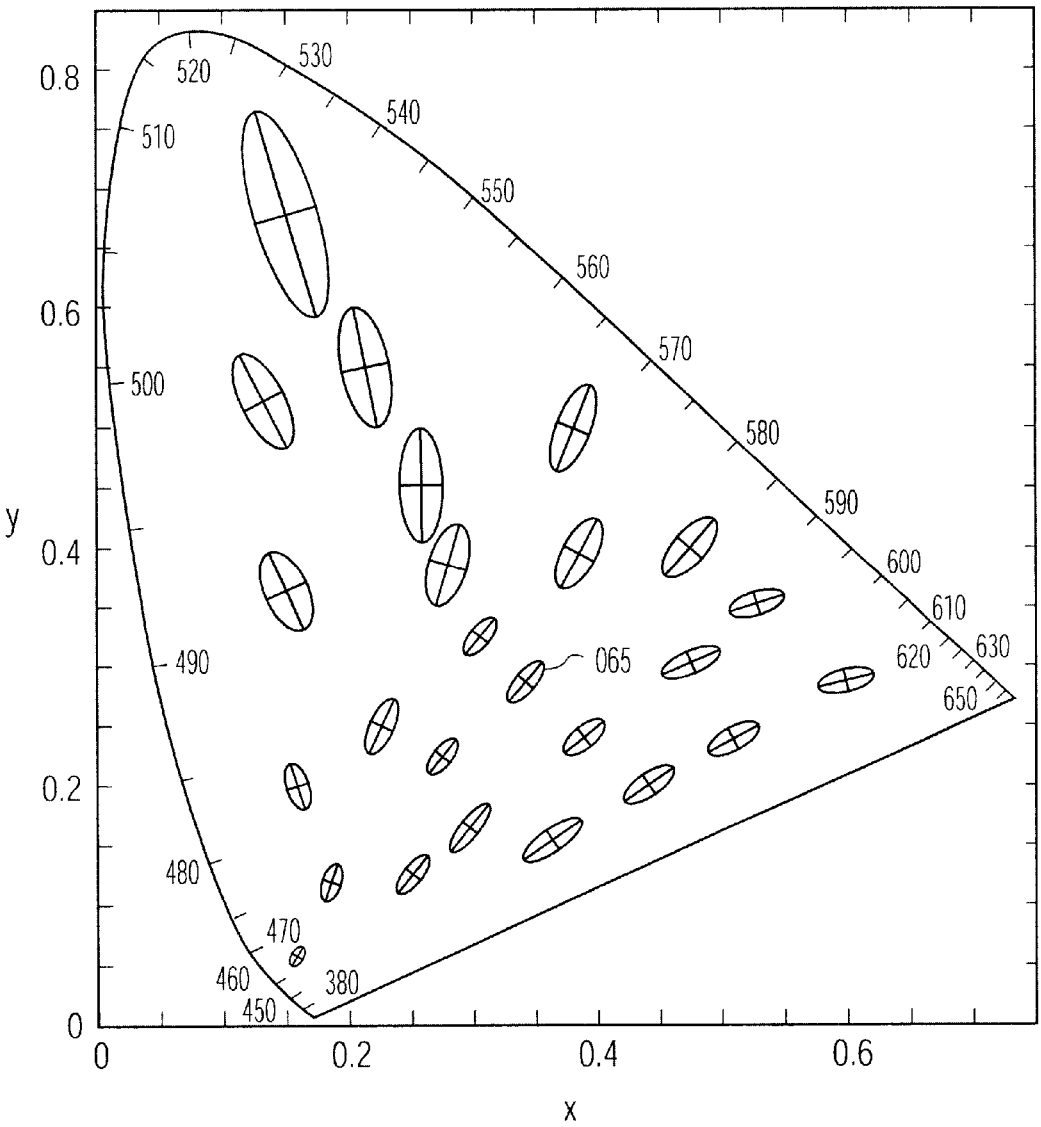
FIG. 5 is a plot of a color space illustrating a plurality of MacAdam ellipses, within which colors are perceived without a substantial change.

Buffer 14 is coupled to an x'L'y' transformation module 30. Transformation module 30, first converts the X,Y,Z, color space into the IEC 1931 chromaticity coordinates (x,y). A color space diagram defined in accordance with IEC 1931 chromaticity coordinates x,y is illustrated in FIG. 5 in accordance with one embodiment of the invention. As illustrated each desired color point within the chromaticity diagram is surrounded by a corresponding ellipse. It is noted that any color deviation within each ellipse causes substantially no perceptible color change.

These ellipses are also known as MadAdam ellipses, as explained in more detail in G. Wyszecki and W. S. Stiles, *Color Science: concepts and methods, quantitative data and formulae*, page 308 (2d Ed. John Wiley & Sons, 1982), and incorporated herein by reference. It is also noted that the axes of the plotted ellipses are 10 times their actual lengths. The x,y transformation is defined as $$x=X/(X+Y+Z), \tag{1}$$

and $$y=Y/(X+Y+Z) \tag{2}$$

As illustrated in FIG. 5, these so called MacAdam ellipses are plotted at different color points in the chromaticity diagram. These ellipses correspond to a standard deviation of color matching with little or no noticeable differences. In order to have a uniform color metric spatially over almost all the color space, transformation module 30, in accordance with one embodiment of the invention, provides a further non-linear transformation to convert these ellipses to circles.

Figure 6:
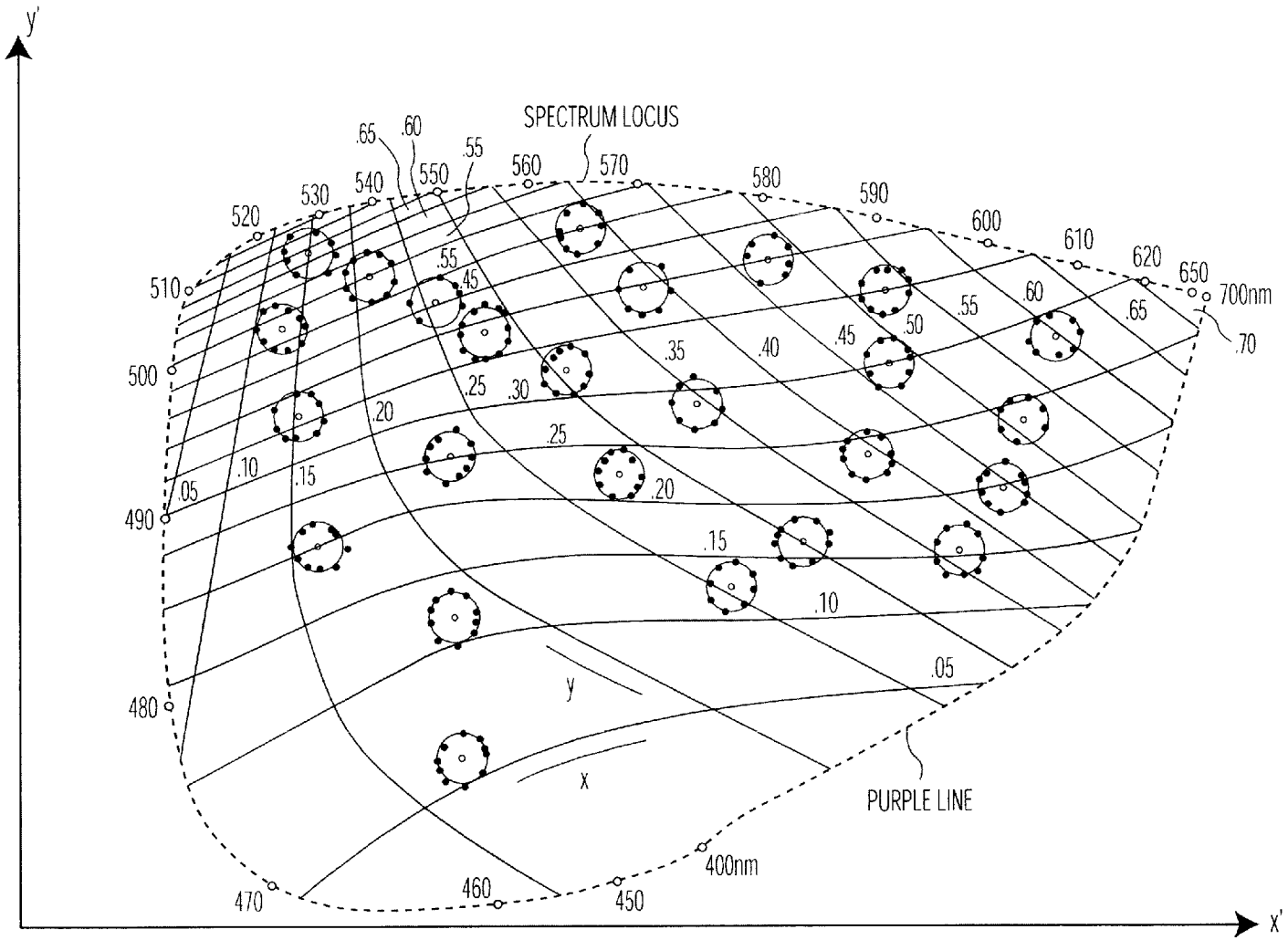
FIG. 6 illustrates a plot of a color space depicting a plurality of circular error regions in accordance with one embodiment of the invention.

An example of one such non-linear transformation of ellipses to circle is a Farnworth transformation, with x',y' coordinates, as illustrated in FIG. 6, wherein all those ellipses of FIG. 5 are transformed to circles with almost identical radius, as explained in more detail by D. Farnsworth *A temporal factor in colour discrimination*, Visual Problems of Color, Vol. II, p. 434 (1957), Nat. Phys. Lab. Symposium No. 8, Her Majesty's Stationery Office, London (1958), and incorporated herein by reference. Thus, the second transformation step of transformation module 30 is defined as $$x'=f_x(x,y) \tag{3},$$

and $$y'=f_y(x,y) \tag{4}.$$

One example of the transformation defined in equations (3) and (4), in accordance with one embodiment of the invention is defined as $$x' = \frac{a_{11}x + a_{12}y + a_{13}}{b_1x + b_2x + b_3} \tag{5}$$

$$y' = \frac{a_{21}x + a_{22}y + a_{23}}{b_1x + b_2x + b_3} \tag{6}$$

wherein, the coefficients $a_{11}$, $a_{12}$ $a_{13}$ $a_{21}$ $a_{22}$ $a_{23}$, $b_1$, $b_2$, $b_3$ are all spatial functions of (x,y) coordinate system. Thus, depending on the desired color point x,y, these coefficients have to be adapted accordingly.

It is noted that transformation module 30 of FIG. 2 employs either a hardware or a software arrangement or a combination of both. Furthermore, within this context, the present invention contemplates employing either a hardware or a software component or a combination of both for each of the modules of system 10.

With continued reference to FIG. 2, the coordinates stored in buffer 14 correspond to a color space that represents colors relative to a desired color point, represented in terms of XYZ space, and transformed by transformation module 30 to new coordinates referred to as $x'_{ref}$, $L'_{ref}$, and $y'_{ref}$, as described above.

Buffer 14 is coupled via transformation module 30, to a feedback adder 16, which is configured to provide an error signal $\Delta x'$, $\Delta L'$, $\Delta y'$, based on the desired color coordinate values and the color coordinate values generated by control system 10.

An output port of feedback adder 16 is coupled to a controller 18, which is configured to provide control voltage signals corresponding to the color space error signals. In accordance with one embodiment of the invention, controller 18 is configured to generate control voltage sources $V_R$, $V_G$, $V_B$, for driving the LEDs, in response to error signals provided by feedback adder 16.

An output port of controller 18 is coupled to an input control of power supply and RGB Driver unit 20. Power supply unit 20 generates appropriate forward current signal levels $i_R$, $i_G$, $i_B$, to each of the RGB LEDs so as to cause the LEDs to generate the corresponding lights for producing a desired white light.

An output port of power supply unit 20 is coupled to an input port of an RGB white LED luminary module 22. A plurality of red, green and blue LEDs within luminary module 22 are configured to receive their corresponding forward drive current signals so as to generate the desired light color. Luminary module 22 provides red, green and blue lights in lumen in response to the current provided to the LEDs.

The light that is generated by luminary 22 is measured by a tristimulus filter 24. Filter 24 is disposed in front of luminary 22 so as to measure certain characteristics of the light generated, such as the color coordinates RGB. As will be explained in more detail later in reference with FIG. 3 and 4, filter 24 in accordance with one embodiment of the invention comprises a photo sensor with color filters that together operate as—what is known in the industry—a tristimulus filter.

Filter 24 is coupled to a color point identification module 26, which is configured to convert the RGB values measured by filter 24 to $X_w$, $Y_w$, $Z_w$ coordinates.

Figure 3A:
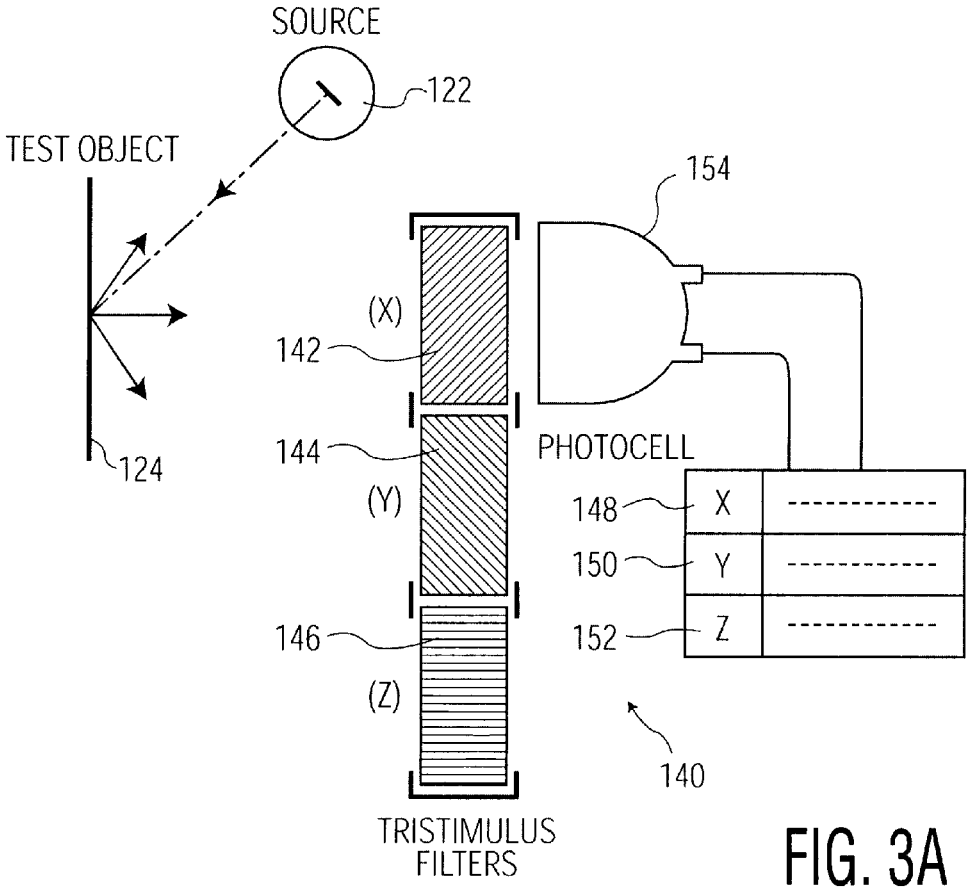
FIGS. 3(*a*)–3(*c*) illustrate various tristimulus filters employed in accordance with another embodiment of the invention.
Figure 3B:
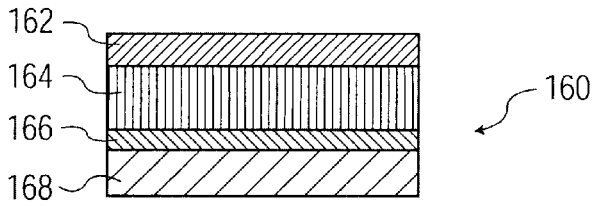
Figure 3C:
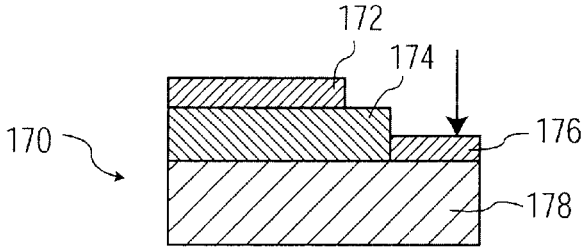

In accordance with one embodiment of the invention, the operation of filter 24 and color point identification module 26 can be combined by a tristimulus filter, such as 140, illustrated in FIGS. 3(*a*)–3(*c*).

The operation and structure of tristimulus filter 140 is well known. FIGS. 3(*a*), 3(*b*) and 3(*c*) illustrate block diagrams of three exemplary tristimulus filters that are employed in accordance with various embodiments of the invention. Basically, a tristimulus filter is configured such that the spectral response functions of the filters are directly proportional to the color-matching functions of CIE standard colorometric observers.

FIG. 3(*a*) illustrates the arrangement and function of a tristimulus filter 140. The tristimulus filter of FIG. 3(*a*) includes three glass filters 142, 144 and 146, each of which are configured to filter respectively the red, green and blue lights contained in a light generated by source 122 and reflected by a test object 124. One or more photocells 154 are disposed behind the glass filters to measure the light output for each of the red, green and blue light components. Registers 148, 150 and 152 are configured to store the light information corresponding to CIE 1931 standard observer. Thus, register 148 stores information corresponding to the light passing through filter 142. Similarly, register 150 stores information corresponding to the light passing through filter 144. And, register 152 stores information corresponding to the light passing through filter 146.

Figure 4A:
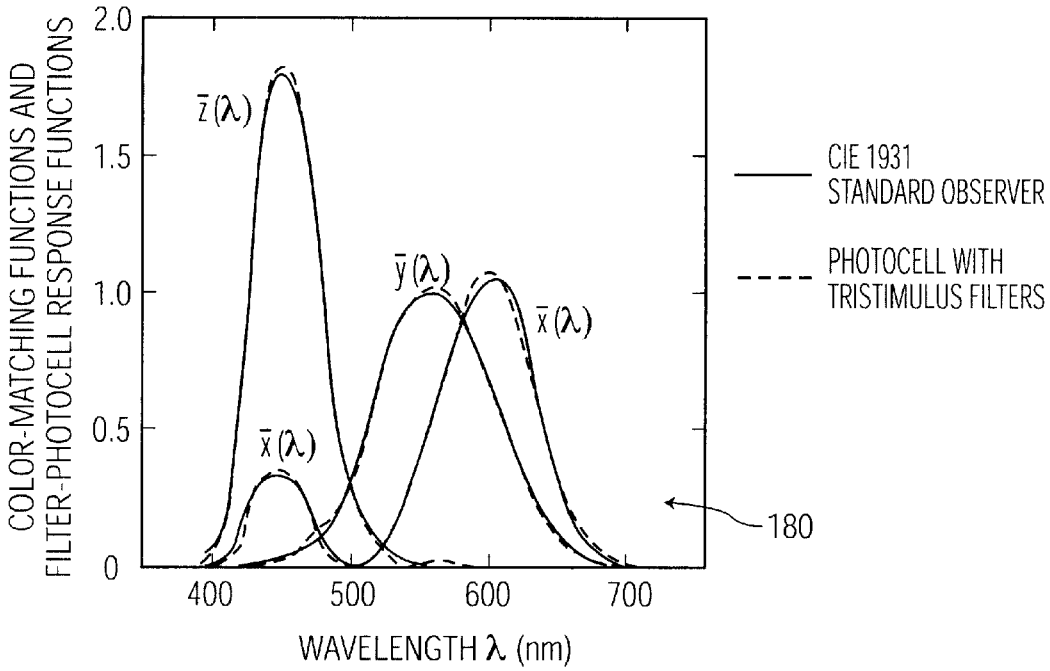
FIGS. 4(*a*)–4(*b*) illustrate plots employed in connection with tristimulus filters illustrated in FIG. 3.
Figure 4B:
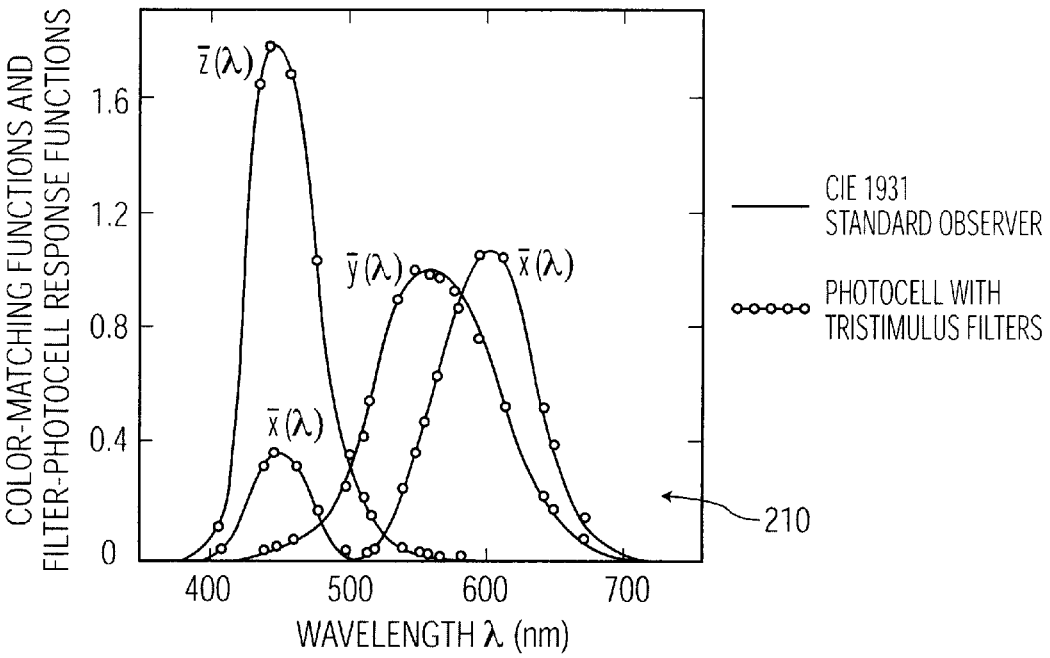

To this end, FIG. 4(*a*) illustrates a plot which depicts the spectral response functions and the degree to which a photocell, such as 154, combined with tristimulus filters 140 may best duplicate the color-matching functions of the CIE 1931 standard observer. The solid curves illustrate the CIE standard observer data, and the dotted curves illustrate response of the photocell with tristimulus filter arrangement.

Other examples of tristimulus filters are illustrated in FIGS. 3(*b*) and 3(*c*) wherein filter glass layers are disposed over a filter substrate. Therefore, as illustrated in FIG. 3(*b*) a substrate 168 receives a glass layer 166, overlapped by a glass layer 164, which in turn is overlapped with a glass layer 162. FIG. 3(*c*) illustrates another variation of glass layers wherein layer 172 does not completely cover layer 174, and layer 174 does not completely cover layer 176.

To this end, FIG. 4(*b*) illustrates a plot which depicts the spectral response functions and the degree to which a photocell, such as 154, combined with the tristimulus filters 160 or 170, may best duplicate the color-matching functions of the CIE 1931 standard observer. The solid curves illustrate the CIE standard observer data, and the dotted curves illustrate response of the photocell with tristimulus filter arrangement.

The output port of color identification module 26 is coupled to an input port of a transformation module 28, which is configured to transform the feedback components of $X_{fdbk}$, $Y_{fdbk}$, $Z_{fdbk}$ coordinates of the light measured by module 26 to a x',L',y' space governed by the equations, explained above, in reference with FIGS. 5 and 6.

An output port of transformation module 28 is coupled to an input port of adder 16. Furthermore, an output port of transformation module 30 is coupled to an input port of transformation module 28. This connection allows the two modules to apply the appropriate transformation coordinates in accordance with the desired color the system is controlling.

It is noted that in accordance with one embodiment of the invention, the coefficients described in equations (5) and (6) can be readily stored in a memory, such as buffer 14, and associated with a corresponding set of x,y coordinates. As such, the desired color coordinates X,Y,Z, can be transformed to MacAdam coordinates x,y, and the associated coefficients retrieved from the memory, so as to calculate Farnsworth coordinates x',y'.

It is noted that control module 18 is configured to generate a control signal in accordance with a function C(s) in frequency domain, based on the error signal received from adder 16.

Furthermore, RGB luminary module 22 is configured to generate lumens in response to the driving current in accordance with a transfer function matrix D(s). Similarly, P(s) is a transfer function matrix defining the operation of driver module 20, N(s) is a tranfer function matrix defining the operation of transformation module 28, T(s) is a transfer function matrix defining the operation of color point identification and transformation module 26, and L(s)is a transfer function matrix defining the operation of filter module 24.

In accordance with one embodiment of the invention the function of the controller as defined by transfer function C(s), can be based on various controller arrangements as is well known in the art. For example, controller 18 can be based on the operation of a class of controllers known as proportional integration (PI) controllers, with a transfer function as $C(s)=K_p+K_I/s$, wherein $K_p$ and $K_I$ are 3×3 constant real matrices.

In accordance with one embodiment of the present invention, typical values of the transfer function C(s) for controller 18, for a given RGB LED set with a peak wavelength $\lambda_r$=643 nm, $\lambda_g$=523 nm and $\lambda_b$=464 nm and a selected set of color sensing filters, such as those manufactured by Hamamatsu with S6430 (R) S6429 (G) and S6428(B), is $$K_p = \begin{bmatrix} 0.1 & 0.9 & -0.12 \\ 0.4 & 0.6 & 0.5 \\ -0.14 & 0.3 & 0.2 \end{bmatrix}$$

$$K_I = \begin{bmatrix} 0.1 & 0.12 & -0.18 \\ 0.13 & 0.8 & 0.05 \\ -0.1 & 0.01 & 0.6 \end{bmatrix}$$

During operation, control system 10, first determines the desired reference X,Y,Z coordinates as provided by buffer 14. Thereafter, transformation module 30 retrieves the appropriate transformation coefficients based on the reference X,Y,Z coordinates, and transforms the reference color space to a reference Farnsworth color space with x',L', y'reference coordinates, by employing equations (5) and (6).

Filter 24 measures the X,Y,Z coordinates of the desired light color generated by luminary module 22 , and transformation module 28 transforms the identified light color defined in X,Y,Z coordinates to a x',L',y' color space. As such, control system 10 controls the color points of the desired light color in the x',y' color space with error measured as $$\Delta x'y' = \sqrt{fheight x'-x'_0)^2+(y'-y'_0)^2} = \epsilon$$

Wherein $(x'_0, y'_0)$ is the targeted or desired color point coordinate, and (x',y) is the actual color point coordinate in the x',y' Farnsworth color space. As a result control system 10 is able to control color errors, for all desired colors, in an arrangement wherein regardless of the location of error on the chromaticity diagram, the perception of color remains the same for the same amount of error. This means that the control system produces substantially a uniform error in color. Therefore, as Δx'y' becomes smaller, the color difference becomes smaller in all directions as well.

The effect of the transformation module is that the control system provides a control scheme wherein the Δx'y' values are almost uniform in all directions in an area that define a circle around a plurality of desired colors. As a result, control system 10 can be assembled in an expeditious and a less costly manner.

Thus, in accordance with various aspects of the present invention, a control system can be designed, for an arrangement wherein any desired light color can be generated and effectively controlled, by transforming the desired color space coordinates to a Farnsworth color space. As such, the control design can be significantly simplified and yet remain very accurate. The light can be generated such that deviations from any desired light color remain unperceivable regardless of the direction of error on the chromaticity plot.

I claim:

1. A control system for generating a desired light color by a plurality of Red, Green and Blue light emitting diodes (LEDs) comprising:

a sensor responsive to a light color generated by said plurality of LEDs to measure the color coordinates of said generated light, wherein said color coordinates are defined in a first color space;

a first transformation module coupled to said sensor to transform said coordinates of said generated light to a second color space;

a second transformation module configured to provide reference color coordinates corresponding to said desired light, wherein said reference color coordinates are expressed in said second color space;

an adder coupled to said first and second transformation modules configured to generate an error color coordinate corresponding to a difference between said desired light color coordinates and said generated light color coordinates; and a driver module coupled to said adder and configured to generate a drive signal for driving said LEDs.

2. The system in accordance with claim 1 wherein said first color space is an x, y, z color space.

3. The system in accordance with claim 2, wherein said second color space is a x'L'y' color space.

4. The system in accordance with claim 1 further comprising a controller coupled to said adder, wherein said controller generates control voltage signals corresponding to said Red, Green and Blue LEDs respectively.

5. The system in accordance with claim 3 wherein said sensor is a tristimulus filter.

6. The system in accordance with claim 5 wherein said first transformation module transforms X,Y,Z color coordinates to MacAdam color coordinates.

7. The system in accordance with claim 6, wherein said first transformation module transforms said MacAdam color coordinates to Farnsworth color coordinates.

8. The system in accordance with claim 1, wherein said second transformation module is coupled to said first transformation module, so as to provide transformation coefficients to said first transformation module.

9. The system in accordance with claim 8, wherein said transformation coefficients vary in accordance with the corresponding desired light color.

10. A method in a control system for generating a desired light by a plurality of Red, Green and Blue light emitting diodes (LEDs) comprising the steps of:

sensing a light generated by said plurality of LEDs to measure the color coordinates of said light, wherein said color coordinates are defined in a first color space;

transforming said coordinates of said generated light to a second color space;

transforming reference color coordinates corresponding to said desired light, wherein said reference color coordinates are expressed in said second color space;

generating an error color coordinate corresponding to a difference between said desired light color coordinates and said generated light color coordinates; and generating a drive signal for driving said LEDs.

11. The method in accordance with claim 10 further comprising the step of defining said first color space as an x,y,z color space.

12. The method in accordance with claim 11, further comprising the step of defining said second color space as a x'L'y' color space.

13. The method in accordance with claim 12 further comprising the step of generating control voltage signals corresponding to said Red, Green and Blue LEDs respectively.

14. The method in accordance with claim 13 wherein said step of transforming said X,Y,Z color coordinates further comprises the step of assigning values in accordance with $$x = X/(X+Y+Z)$$

$$y = Y/(X+Y+Z)$$

to transform into a MacAdams space; and transforming said x,y color coordinates via the step of assigning values in accordance with $$x' = \frac{a_{11}x + a_{12}y + a_{13}}{b_1x + b_2x + b_3}$$

$$y' = \frac{a_{21}x + a_{22}y + a_{23}}{b_1x + b_2x + b_3}$$

to transform into a Farnsworth space, wherein, the coefficients $a_{11}$, $a_{12}$, $a_{13}$, $a_{21}$, $a_{22}$, $a_{23}$, $b_1$, $b_2$, $B_3$ are all spatial functions of (x,y) coordinate system.

* * * * *